United States Patent [19]

Stratford et al.

[11] Patent Number: 4,919,590

[45] Date of Patent: Apr. 24, 1990

[54] COMPRESSOR AND AIR BLEED ARRANGEMENT

[75] Inventors: Brian S. Stratford; Edward S. Hadaway; John Chew; Howard G. Hartland, all of Derby, England

[73] Assignee: Rolls-Royce plc, London, England

[21] Appl. No.: 376,149

[22] Filed: Jul. 7, 1989

Related U.S. Application Data

[63] Continuation of Ser. No. 201,740, Jun. 3, 1988, abandoned.

[30] Foreign Application Priority Data

Jul. 18, 1987 [GB] United Kingdom ..... 8717015

[51] Int. Cl.[5] ..... F04D 31/00

[52] U.S. Cl. ..... 415/116; 60/726

[58] Field of Search ..... 415/115, 116, 144, 175, 415/176, 178, 914; 416/198 A; 60/726, 39.07, 39.82

[56] References Cited

U.S. PATENT DOCUMENTS

| | | | |
|---|---|---|---|
| 3,085,400 | 4/1963 | Sonder et al. | 415/115 |
| 3,632,221 | 1/1972 | Uehling | 415/115 |
| 3,742,706 | 7/1973 | Klompas | 60/726 |
| 4,008,977 | 2/1977 | Brown et al. | 60/726 X |
| 4,127,988 | 12/1978 | Becker | 415/115 X |
| 4,231,704 | 11/1980 | Ayache et al. | 416/95 |
| 4,335,995 | 6/1982 | Riollet et al. | 415/144 |
| 4,415,310 | 11/1983 | Bouiller et al. | 415/144 X |
| 4,595,339 | 6/1986 | Naudet | 415/115 X |

FOREIGN PATENT DOCUMENTS

| | | | |
|---|---|---|---|
| 622181 | 4/1949 | United Kingdom . | |
| 712051 | 7/1954 | United Kingdom . | |
| 789204 | 1/1958 | United Kingdom . | |
| 877976 | 9/1961 | United Kingdom | 415/DIG. 1 |
| 885951 | 1/1962 | United Kingdom . | |
| 1344381 | 1/1974 | United Kingdom . | |

*Primary Examiner*—Robert E. Garrett
*Assistant Examiner*—John T. Kwon
*Attorney, Agent, or Firm*—Cushman, Darby & Cushman

[57] ABSTRACT

The present invention relates to air bleed arrangements on a compressor of a gas turbine engine. A rotor of the compressor has a plurality of stages of rotor blades, and the rotor is formed from a plurality of axially adjacent rotor discs. Two axially adjacent rotor discs define a chamber therebetween for a radially inward flow of bleed air. The rotor is provided with a plurality of apertures in rotor disc which bleed air from the compressor and supply the bleed air to the chamber. The adjacent rotor discs have opposing radially extending surfaces, and one of the opposing surfaces has a plurality of circumferentially spaced radially extending vanes and radially extending grooves which direct the bleed air radially inwardly to minimize pressure losses in the bleed air flowing through the chamber. This arrangement is not complex, is relatively easy and inexpensive to manufacture, has reduced weight and allows compressor to be manufactured by welding the rotor discs together.

12 Claims, 6 Drawing Sheets

COMPRESSOR AND AIR BLEED ARRANGEMENT

This is a continuation of application Ser. No. 201,740 filed June 3, 1988, which was abandoned upon the filing thereof.

The present invention relates to compressors, and is concerned with an air bleed arrangement for the compressor, particularly for the compressor of a gas turbine engine.

In gas turbine engines it is normal practice to bleed air from the compressor or compressors and to supply the bleed air to the turbine or turbines of the gas turbine engine in order to carry out sealing and cooling of the turbine or turbines.

The bleed air must be supplied to the turbine or turbines from the compressor or compressors with minimum pressure loss so that it has sufficient pressure to cool and give sealing at the turbine or turbines.

In one bleed arrangement the bleed air is bled from the compressor generally in a radially inwardly direction and is then supplied in a downstream direction through the center of the engine, for example through drive shafts or other suitable means, to the turbine. The bleed air is passed generally radially through a vortex reducer in order to ensure that there is a minimum pressure loss in the bleed air.

One of the prior art vortex reducers comprises a number of radially extending tubes through which the bleed air flows from the compressor.

British Patent Nos. 622181 and 712051 are examples of prior attempts to reduce vortex pressure losses. In GB622181 a number of radially extending passages are formed between inwardly directed ribbed flanges on a spacer ring positioned between adjacent compressor rotor discs. In GB712051 a pair of thin discs are positioned between adjacent compressor rotor discs, and a plurality of rotary guide vanes are mounted between and are secured to the thin discs. The rotary guide vanes are formed to allow a free vortex and these vanes spiral radially inwardly. The ribs or vanes in both these prior published patents extend the full axial distance, of a bleed chamber formed, between the ribbed flanges or thin discs.

These prior art arrangements are complex, relatively heavy and are costly to manufacture. In addition such arrangements are not desirable from a manufacturing point of view as they prevent the use of beam welders to bond adjacent compressor rotor discs together.

The present invention seeks to provide a compressor with an air bleed means which has a vortex reducer of reduced weight, which is cheaper to manufacture and allows the compressor rotor discs to be bonded together.

Accordingly the present invention provides an axial flow compressor comprising a rotor having a plurality of stages of circumferentially spaced radially outwardly extending rotor blades, a casing surrounding and spaced from the rotor and rotor blades, the rotor comprising at least two axially adjacent rotor discs defining a chamber therebetween, air bleed means integral with the rotor arranged to bleed a portion of air from the compressor and supply it radially inwardly to said chamber, the said two axially adjacent rotor discs having opposed radially extending surfaces, at least one of the opposed radially extending surfaces being contoured to direct the bleed air radially inwardly to prevent the formation of a free vortex within said chamber and thereby reduce pressure losses in the bleed air flowing through the chamber.

The contouring of the at least one of the radially extending surfaces may comprise a plurality of circumferentially spaced radially extending vanes, the vanes extend axially from the at least one of the opposed radially extending surfaces by a substantially small proportion of the axial distance between the opposed radially extending surface of the adjacent rotor discs.

Preferably the at least one of the opposed radially extending surfaces is an upstream radially extending surface of an axially downstream rotor disc of said two axially adjacent rotor discs.

Both of the opposed radially extending surfaces of the axially adjacent rotor discs may be contoured.

The plurality of circumferentially spaced radially extending vanes may extend axially from at least one of the opposed radially extending surfaces of the adjacent rotor discs by at least substantially the width of a boundary layer formed on said surface of the adjacent rotor discs.

The plurality of circumferentially spaced radially extending vanes may be shrouded or unshrouded.

The air bleed means may comprise a plurality of circumferentially arranged apertures extending through the rotor.

The air bleed means may be integral with an axially upstream rotor disc of said two axially adjacent rotor discs.

The air bleed means may be integral with an axially downstream rotor disc of said two axially adjacent rotor discs.

The apertures of the air bleed means may extend radially through the rotor to direct the bleed air radially or may be inclined to the radial direction to direct the bleed air tangentially.

The present invention will be more fully described by way of example, with reference to the accompanying drawings in which.

Figure 1:
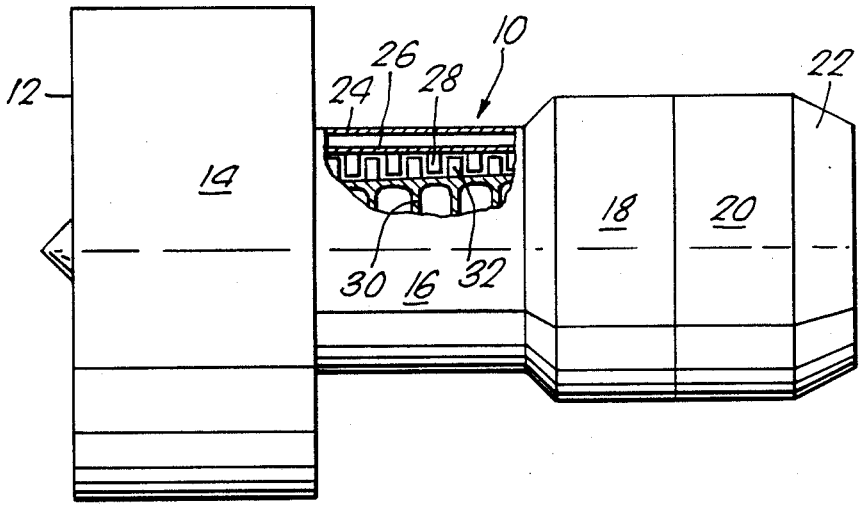
FIG. 1 is a partially cut-away view of a gas turbine engine having a compressor and an air bleed arrangement according to the present invention.

A turbofan gas turbine engine 10 is shown in FIG. 1, and comprises in axial flow series an inlet 12, a fan 14, a compressor 16, a combustion system 18, turbines 20 and an exhaust nozzle 22. The turbofan gas turbine engine 10 works conventionally, in that air is initially compressed by the fan 14, and a portion of this compressed air is supplied to the compressor 16. The compressor 16 further compresses the air and supplies the compressed air to the combustion system 18. Fuel is injected into the combustion system 18, and is burnt in the air to produce hot gases. The hot gases flow through and drive the turbines 20, before passing to atmosphere through the exhaust nozzle 22. The turbines 20 are drivingly connected to the fan 14 and compressor 16 via shafts (not shown).

The compressor 16 comprises a rotor 30 which carries a plurality of stages of rotor blades 32, each of the stages of rotor blades 32 are arranged circumferentially on the rotor 30 and extend radially outwardly therefrom. An inner casing 26 is spaced radially from and surrounds the rotor 30 and rotor blades 32, and the inner casing, 26 carries a plurality of stages of stator vanes 28. Each of the stages of stator vanes 28 are arranged circumferentially on the inner casing 26, and extend radially inwardly therefrom. The stages of rotor blades 32 and stator vanes 28 are arranged axially alternately. An outer casing 24 is spaced radially from and surrounds the inner casing 26.

Figure 3:
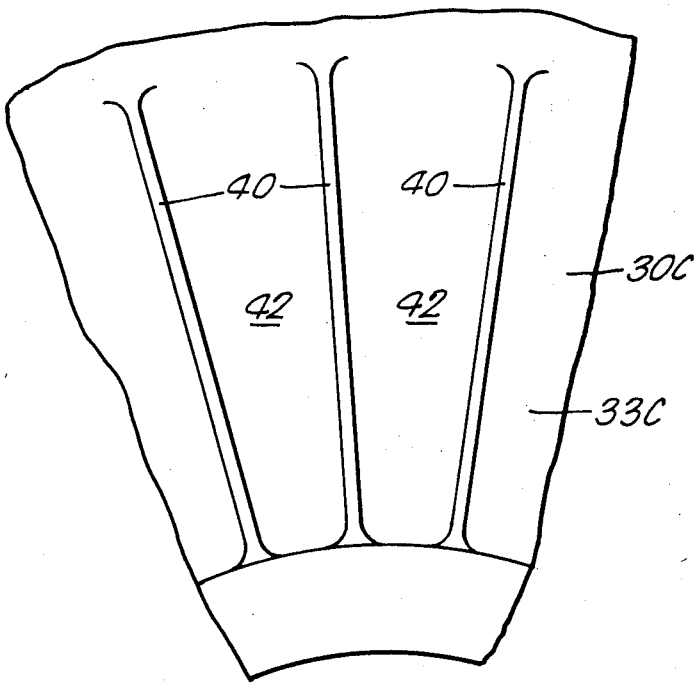
FIG. 3 is a view in the direction of arrow A in FIG. 2.
Figure 2:
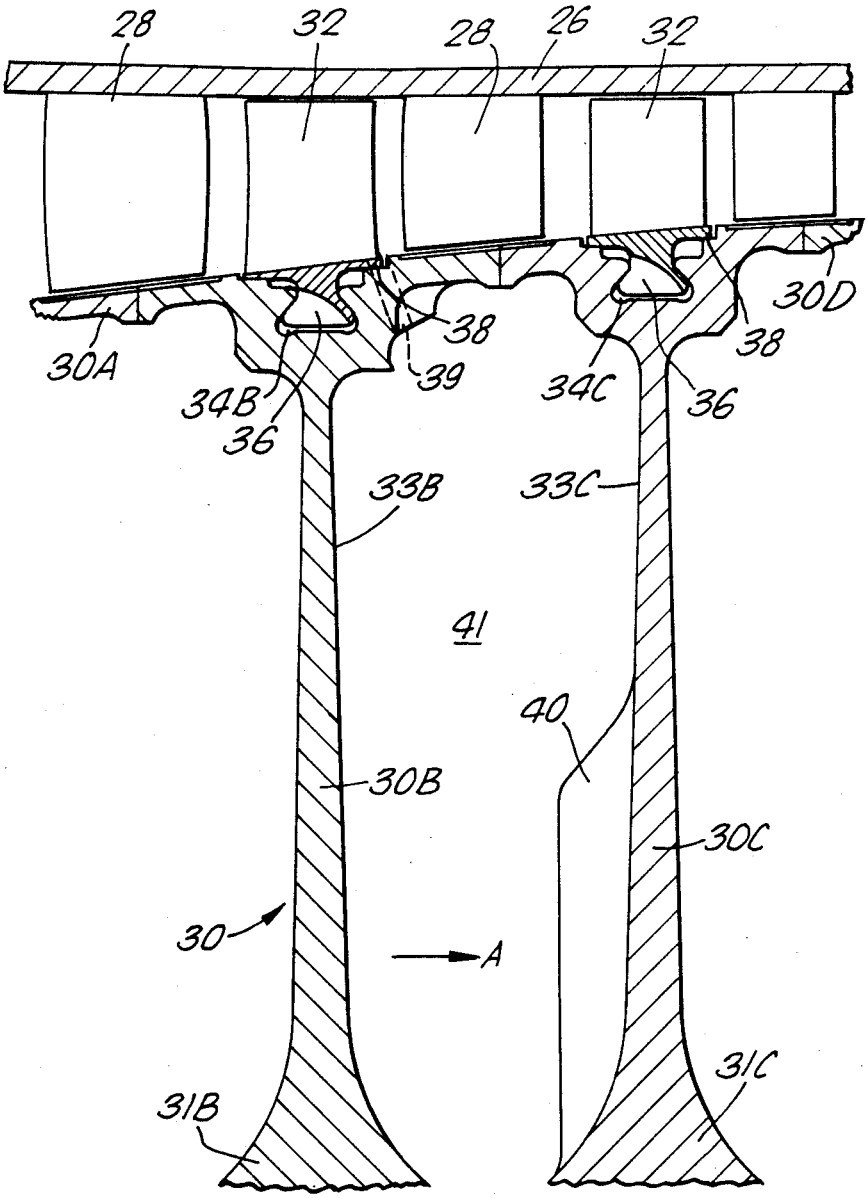
FIG. 2 is an enlarged longitudinal sectional view of part of the compressor showing the air bleed arrangement according to the present invention.

A portion of the compressor 16 and a bleed arrangement are shown more clearly in FIGS. 2 and 3. The rotor 30 comprises a number of axially arranged rotor discs 30A,30B,30C and 30D, in which adjacent ones of the rotor discs 30A,30B,30C and 30D have axially upstream and downstream extending annular members at their radially outer ends for the purpose of securing the adjacent rotor discs 30A,30B,30C and 30D together. The rotor discs 30A,30B,30C and 30D are secured together by a welding process, for example by electron beam welding or laser beam welding or other suitable welding process. The flanges of adjacent rotor discs 30A,30B,30C and 30D are welded together by passing the welding apparatus axially through the rotor discs and welding on the radially inner surfaces of the axially extending annular members. The weld has then to be machined flat and inspected.

A stage of rotor blades 32 is secured to each of the rotor discs 30A,30B,30C and 30D, and in this example the rotor discs 30B and 30C are provided with circumferentially extending slots or grooves 34B and 34C within which the roots 36 of the rotor blades 32 fit and are retained. The roots 36 of the rotor blades 32 are of the dovetail type and the grooves 34B and 34C are correspondingly shaped to receive the roots 36. The rotor blades 32 have platforms 38 which form a smooth continuation to the radially outer surface of the rotor 30 which defines the inner boundary of the flow path for the air through the compressor 16.

The rotor 30 is provided with an air bleed device which comprises a plurality of circumferentially arranged apertures 39 which extend through the rotor 30 to bleed off a portion of the compressed air flowing through the compressor 16. The portion of compressed air is used for cooling the turbines 20 and also for sealing purposes in the turbines 20. The apertures 39, in this example, are provided in the rotor disc 30B in the axially downstream extending annular member, but could be provided in the axially upstream extending annular member of the rotor disc 30C. The portion of air bled from the compressor 16 flows radially inwardly through a chamber 41 formed axially between opposed radially extending surfaces 33B,33C of the adjacent rotor discs 30B and 30C, and then flows in an axially downstream direction through the center of the engine, for example through the drive shafts (not shown) or other suitable means, to the turbines 20 for the purposes previously mentioned.

As mentioned previously the air bled from the compressor 16 must be supplied to the turbines 20 with minimum pressure loss to give optimum cooling and sealing in the turbines 20. The prior art arrangements for minimizing the pressure loss require complex structures positioned between adjacent rotor discs, which are relatively heavy, costly and prevent the use of the desired manufacturing process for the rotor 30.

The rotor disc 30C is provided with a plurality of circumferentially arranged radially extending ribs or vanes 40 which are formed integrally, machined or fabricated on the upstream radially extending surface 33C of the rotor disc 30C, and a plurality of radially extending grooves or channels 42 are formed, between adjacent ribs or vanes 40, as seen in FIG. 3. There are for example thirty ribs or vanes 40 and thirty grooves or channels 42 formed on the rotor disc 30C. The downstream radially extending surface 33B of the rotor disc 30B is not provided with radially extending vanes or grooves, in this example. The vanes 40 as shown in this embodiment are unshrouded for simplicity.

Figure 4:
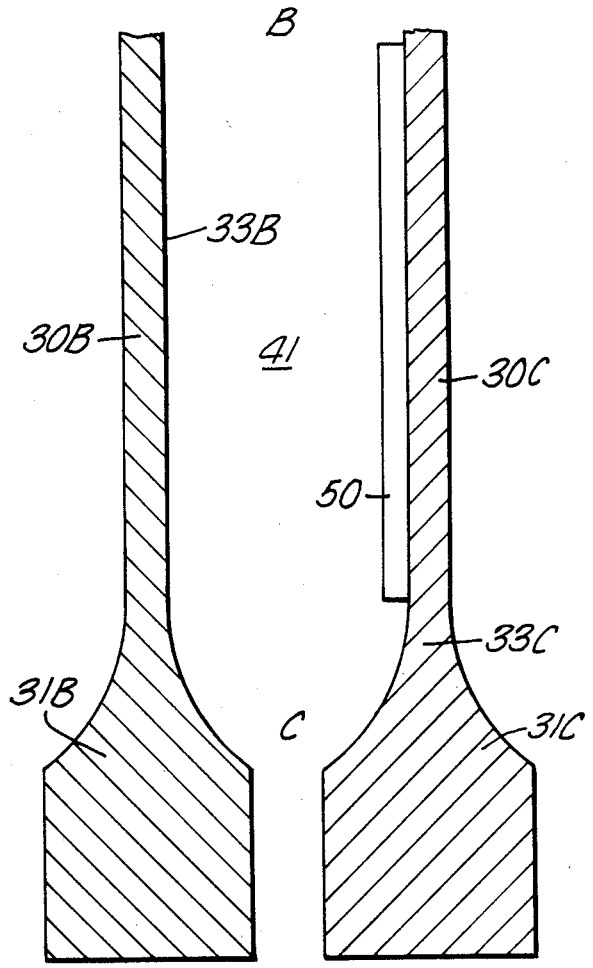
FIG. 4 is an enlarged longitudinal sectional view of part of the compressor showing a second embodiment of an air bleed arrangement according to the present invention.

A second embodiment, is shown in FIG. 4, of the rotor disc 30C and this also has a plurality of circumferentially arranged radially extending ribs or vanes 50, and a plurality of grooves or channels, formed between adjacent vanes 50. The vanes 50 are dimensioned so that they are approximately 5 mm wide, and extend axially for up to approximately 10 mm from the upstream radially extending surface 33C of the rotor disc 30C, and extend radially inwardly to adjacent the cob 31C of disc 30C. The vanes 50 preferably extend axially from the upstream radially extending surface 33C of the rotor disc 30C by at least the thickness of the Ekman layer, or boundary layer on the rotor disc. The vanes 50 in this embodiment are also unshrouded.

In operation as the portion of air bled from the compressor 16 flows through the apertures 39 into the chamber 41 between the rotor discs 30B and 30C a source region B of air is formed at the radially outer extremity of the chamber 41. The source region B is not symmetric, but extends further radially inwards on the disc 30B.

The bleed air flows radially inwardly on the upstream radially extending surface 33C of the rotor disc 30C and the downstream radially extending surface 33B of the rotor disc 30B. The bleed air flowing on the radially extending surfaces 33B,33C of the rotor discs 30B,30C, flows in the Ekman layers or boundary layers on the rotor discs 30B,30C, and the bleed air flowing on the surface 33C of rotor disc 30C reaches the cob 31C of the rotor disc 30C before the bleed air flowing on the surface 33B of rotor disc 30B reaches the cob 31B of the rotor disc 30B. A sink region C is formed in the chamber 41 adjacent, but radially outwards of the cob 31B and 31C. The sink region C acts as a source region for the flow of bleed air radially inwardly between the cobs 31B and 31C in Ekman layers or boundary layers formed on the cobs 31B and 31C.

An unbalanced flow of the portion of bleed air occurs, a greater proportion of the portion of air bled from the compressor 16 flows radially inwardly on the upstream radially extending surface 33C of the rotor disc 30C along the grooves or channels than flows radially inwardly on the plane downstream radially extending surface 33B of the rotor disc 30B in the Ekman layer, or boundary layer, formed thereon The upstream radially extending surface 33C of the rotor disc 30C is therefore contoured to direct the air bled from the compressor radially inwardly to substantially reduce the radial pressure losses in the portion of air bled from the compressor 16.

The vanes 40 and 50, and grooves 42 provided by the invention on the rotor disc 30C significantly reduce the radial pressure losses by preventing the formation of a free vortex in the radial inflow of bleed air in the chamber 41, it reduces the swirl in the bleed air below that of a free vortex.

The vanes 40 and 50 preferably extend axially from the rotor disc by a small proportion of the axial distance between the radially extending surfaces 33B and 33C and extend axially by at least the thickness of the boundary layer, the boundary layer is approximately 2 to 3 mm thick, but the vanes are more effective if they extend axially up to approximately 10–12 mm from the radially extending surface 33C of the rotor disc 30C. The numbers of vanes on the rotor disc 30C and their axial extent from the radially extending surface 33C can be varied, for example there could be thirty vanes which extend 10–12 mm from the radially extending surface 33C, or sixty vanes which extend 5–6 mm from the radially extending surface 33C.

Figure 5:
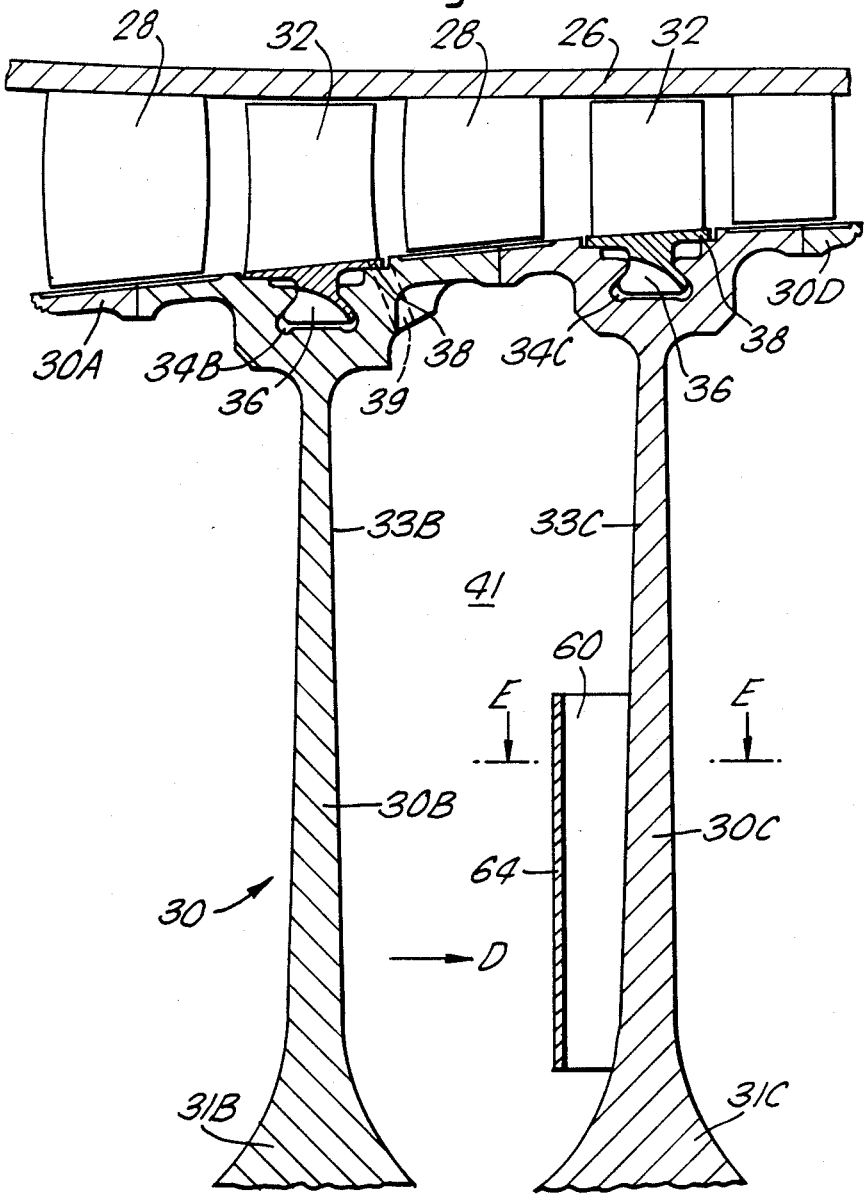
FIG. 5 is an enlarged longitudinal sectional view of part of the compressor showing a third embodiment of an air bleed arrangement according to the present invention.
Figure 6:
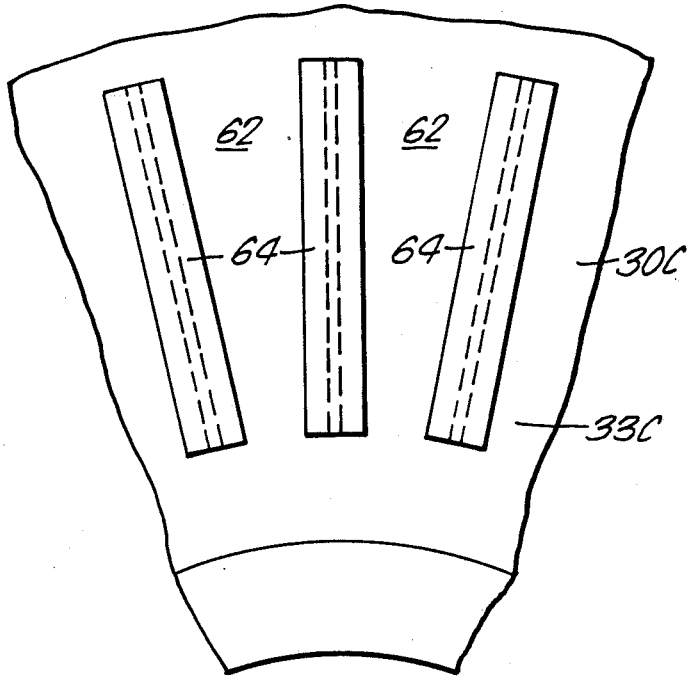
FIG. 6 is a view in the direction of arrow D in FIG. 5.
Figure 7:
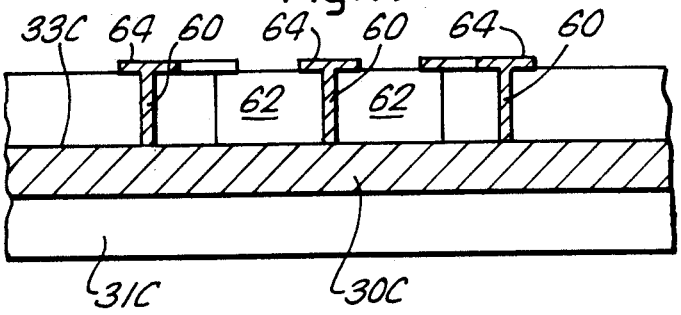
FIG. 7 is a section view E—E in FIG. 5.
Figure 8:
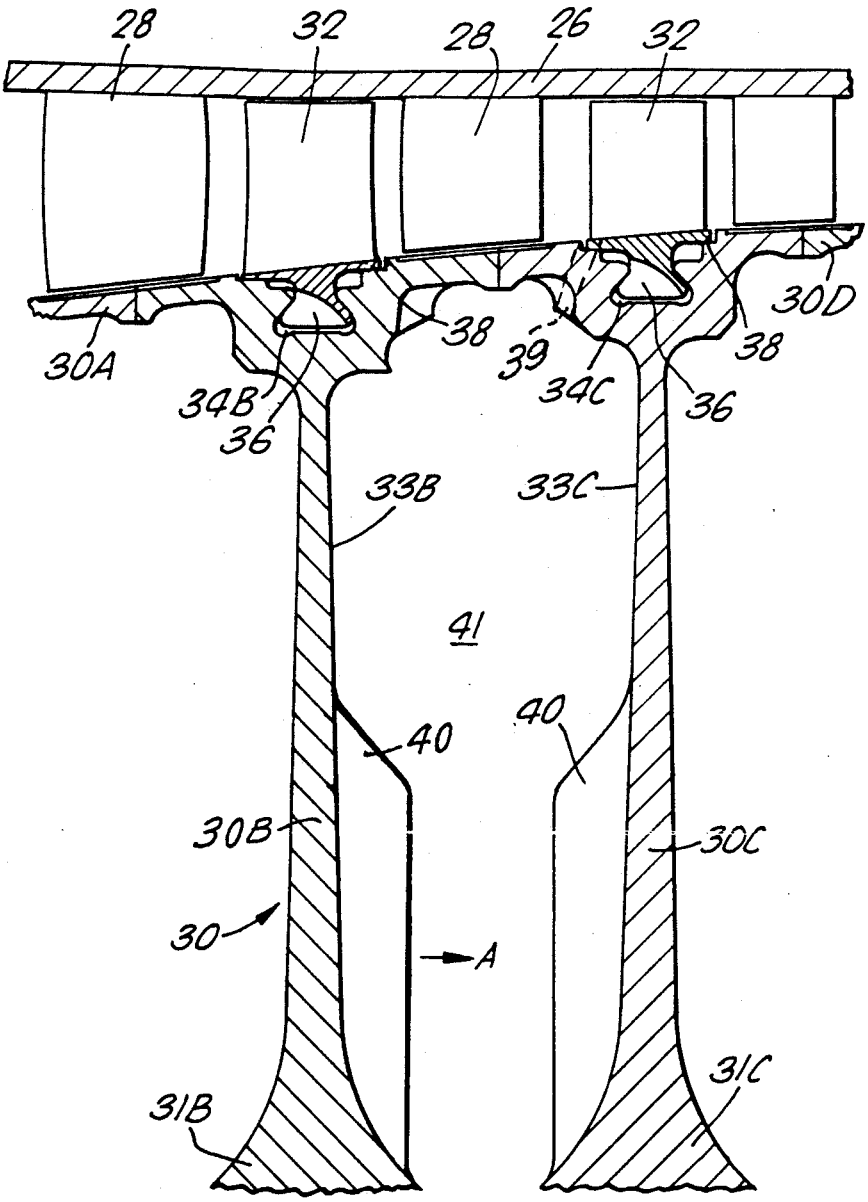
FIG. 8 is a view similar to FIG. 2 but showing vanes 40 on rotor discs 30B and 30C and apertures 39 in the downstream rotor 30C.

A third embodiment of the rotor disc 30C is shown in FIGS. 5,6,7 and this also has a plurality of circumferentially arranged radially extending ribs or vanes 60, and a plurality of grooves or channels 62 are formed between adjacent vanes 60. The vanes 60, in this example, each have a shroud 64, which extends circumferentially from the vanes 60. The shrouds 64 could extend circumferentially from the vanes 60 such that they form a single circumferentially continuous shroud to define completely enclosed channels 62.

The vanes in all these embodiments can be varied radial length, they may extend the full radius of a rotor disc including the cob, or they may extend only a small portion of the radial extent of the disc to stabilize the bleed flow through the chamber between the discs.

The arrangement is not complex, is relatively easy, and cheaper to manufacture, reduces the weight of the engine and allows the compressor rotor 30 to be manufactured by welding together adjacent rotor discs 30A,30B,30C and 30D. It can be seen that the vanes 40 and 50, because of their relatively small axial extent from the radially extending surface 33C of the rotor disc 30C, do not prevent the use of welding equipment, machining equipment or inspection equipment in the chamber 41 between the rotor discs 30B and 30C.

It is also possible to apply the vane and groove arrangement to the downstream radially extending surface 33B of the rotor disc 30B. The apertures 39 in the rotor 30 may be purely radial or may be angled to direct the portion of air bled from the compressor with a tangential component, it may also be possible to use a plurality of vanes integral with the rotor 30 to bleed air radially from the compressor 16.

If the vanes 40 are applied only to a single rotor disc, it is preferred that they are applied to the downstream disc as this is the hotter of the two, and the bleed air will more easily flow radially inwardly.

The invention refers to vanes extending axially from the radially extending surface of the disc, it also includes channels formed in the radially extending surface of the disc or other suitable contouring of the radially extending surface of the disc which will direct the bleed air radially inwardly.

We claim:

1. An axial flow compressor comprising a rotor and a casing, the rotor having a plurality of stages of circumferentially spaced radially outwardly extending rotor blades, the rotor comprising at least two axially adjacent rotor discs, the rotor discs being axially spaced and defining a chamber therebetween each rotor disc carrying one of the plurality of stages of rotor blades, the casing surrounding and being spaced from the rotor and rotor blades, air bleed means integral with the rotor arranged to bleed a portion of air from the compressor and supply the portion of air radially inwardly to said chamber, said two axially adjacent rotor discs having opposed radially extending surfaces, at least one of the opposed radially extending surfaces being contoured, the contouring extending axially from the at least one of the opposed radially extending surfaces up to six times the width of a boundary layer formed on the at least one of the opposed radially extending surfaces, the contouring of the at least one of the opposed radially extending surfaces directing the bleed air radially inwardly to prevent the formation of a free vortex within said chamber and thereby reduce pressure losses in the bleed air flowing through the chamber.

2. An axial flow compressor as claimed in claim 1 in which the at least one of the opposed radially extending surfaces is an upstream radially extending surface of an axially downstream rotor disc of said two axially adjacent rotor discs.

3. An axial flow compressor as claimed in claim 1 in which both of the opposed radially extending surfaces of the axially adjacent rotor discs being connected.

4. An axial flow compressor as claimed in claim 1 in which the contouring of the at least one of the radially extending surfaces comprises a plurality of circumferentially spaced radially extending vanes.

5. An axial flow compressor as claimed in claim 4 in which the plurality of circumferentially spaced radially extending vanes are unshrouded.

6. An axial flow compressor as claimed in claim 4 in which the plurality of circumferentially spaced radially extending vanes are shrouded.

7. An axial flow compressor as claimed in claim 1 in which the air bleed means comprises a plurality of circumferentially arranged apertures extending through the rotor.

8. An axial flow compressor as claimed in claim 7 in which the apertures extend radially through the rotor to direct the bleed air radially.

9. An axial flow compressor as claimed in claim 1 in which the air bleed means is integral with an axially upstream rotor disc of said two axially adjacent rotor discs.

10. An axial flow compressor as claimed in claim 1 in which the air bleed means is integral with an axially downstream rotor disc of said two axially adjacent rotor discs.

11. An axial flow compressor comprising a rotor and a casing, the rotor having a plurality of stages of circumferentially spaced radially outwardly extending rotor blades, the rotor comprising at least two axially adjacent rotor discs, the rotor discs being axially spaced and defining a chamber therebetween, each rotor disc carrying one of the plurality of stages of rotor blades, the casing surrounding and being spaced from the rotor and rotor blades, air bleed means integral with the rotor arranged to bleed a portion of air from the compressor and supply the portion of air radially inwardly to said chamber, said two axially adjacent rotor discs having opposed radially extending surfaces, at least one of the opposed radially extending surfaces being contoured, the contouring extending axially from the at least one of the opposed radially extending surfaces, said contouring of the at least one of the radially extending surfaces comprising a plurality of circumferentially spaced radially extending vanes with said vanes extending axially up to six times the width of a boundary layer formed on the at least one of the opposed radially extending surfaces, there being thirty equi-circumferentially spaced vanes, the contouring of the at least one of the opposed radially extending surfaces directing the bleed air radially inwardly to prevent the formation of a free vortex within said chamber and thereby reduce pressure losses in the bleed air flowing through the chamber.

12. An axial flow compressor comprising a rotor and a casing, the rotor having a plurality of stages of circumferentially spaced radially outwardly extending rotor blades, the rotor comprising at least two axially adjacent rotor discs, the rotor discs being axially spaced and defining a chamber therebetween, each rotor disc carrying one of the plurality of stages of rotor blades, the casing surrounding and being spaced from the rotor and rotor blades, air bleed means integral with the rotor arranged to bleed a portion of air from the compressor and supply the portion of air radially inwardly to said chamber, said two axially adjacent rotor discs having opposed radially extending surfaces, at least one of the opposed radially extending surfaces being contoured, the contouring extending axially from the at least one of the opposed radially extending surfaces up to three times the width of a boundary layer formed on the at least one of the opposed radially extending surfaces from the at least one of the opposed radially extending surfaces, there being sixty equi-circumferentially spaced vanes, the contouring of the at least one of the opposed radially extending surfaces directing the bleed air radially inwardly to prevent the formation of a free vortex within said chamber and thereby reduce pressure losses in the bleed air flowing through the chamber.

* * * * *